US011605317B2

(12) United States Patent
Owen

(10) Patent No.: US 11,605,317 B2
(45) Date of Patent: Mar. 14, 2023

(54) PORTABLE SIGN FRAME

(71) Applicant: American Louver Company, Des Plaines, IL (US)

(72) Inventor: Robert Owen, Chicago, IL (US)

(73) Assignee: American Louver Company, Des Plaines, IL (US)

( * ) Notice: Subject to any disclaimer, the term of this patent is extended or adjusted under 35 U.S.C. 154(b) by 0 days.

(21) Appl. No.: 16/833,159

(22) Filed: Mar. 27, 2020

(65) Prior Publication Data

US 2021/0304645 A1 Sep. 30, 2021

(51) Int. Cl.
*G09F 15/00* (2006.01)

(52) U.S. Cl.
CPC ..... *G09F 15/0062* (2013.01); *G09F 15/0012* (2013.01)

(58) Field of Classification Search
CPC ..... G09F 15/0062; G09F 15/0012
See application file for complete search history.

(56) References Cited

U.S. PATENT DOCUMENTS 4,253,260 A * 3/1981 Maza ..... G09F 15/0062 116/63 P
4,999,937 A * 3/1991 Bechtold ..... G09F 15/0062 16/329
5,964,053 A * 10/1999 Liu ..... G09F 15/0062 116/63 P
6,131,320 A * 10/2000 Eberle ..... G09F 15/0062 40/606.18
9,286,814 B1 * 3/2016 Thomaselli ..... E01F 9/012
2004/0232304 A1 * 11/2004 Wakura ..... G09F 7/22 248/454
2006/0032098 A1 * 2/2006 Glass ..... G09F 15/0062 40/610
2008/0216370 A1 * 9/2008 Glass ..... G09F 15/0062 40/610
2009/0183409 A1 * 7/2009 Thomas ..... G09F 15/0062 40/610
2011/0239506 A1 * 10/2011 Glass, Jr. ..... G09F 15/0062 40/610
2013/0207061 A1 * 8/2013 Montgomery ..... E04H 17/16 256/26
2019/0392738 A1 * 12/2019 Topcuoglu ..... G09F 15/0012

* cited by examiner

*Primary Examiner* — Gary C Hoge
(74) *Attorney, Agent, or Firm* — McDermott Will and Emery LLP

(57) ABSTRACT

A sign frame is provided. In one aspect, the sign frame includes a first panel and a first coupling assembly. The first coupling assembly is integrally formed with the first panel. The sign frame includes a second panel and a second coupling assembly. The second coupling assembly is integrally formed with the second panel. The second coupling assembly is removably coupled to the first coupling assembly. The first panel operatively pivots with respect to the second panel, between a stowed position and a deployed position, about the first coupling assembly and the second coupling assembly that are removably coupled.

20 Claims, 11 Drawing Sheets

PORTABLE SIGN FRAME

TECHNICAL FIELD

This disclosure generally relates to signage, and more specifically relates to portable sign frames.

BACKGROUND

Signage systems are generally known in the art. However, such conventional signage systems typically require additional hardware for assembly, which can lessen durability due to corrosion of the additional hardware. Further, such conventional signage systems can be difficult to transport.

Accordingly, there is an unmet need for an improved portable sign frame. The present disclosure seeks to overcome some limitations and other drawbacks of the prior art, and to provide new features not heretofore available. A full discussion of the features and advantages of the present disclosure is deferred to the following detailed description, which proceeds with reference to the accompanying drawings.

SUMMARY

According to certain aspects of the present disclosure, a sign frame is provided. The sign frame includes a first panel and a first coupling assembly. The first coupling assembly is integrally formed with the first panel. The sign frame includes a second panel and a second coupling assembly. The second coupling assembly is integrally formed with the second panel. The second coupling assembly is removably coupled to the first coupling assembly. The first panel operatively pivots with respect to the second panel, between a stowed position and a deployed position, about the first coupling assembly and the second coupling assembly that are removably coupled.

According to certain aspects of the present disclosure, a sign frame is provided. The sign frame includes a first panel including a first front surface disposed opposite a first rear surface. A first coupling assembly is integrally formed with the first panel. The first coupling assembly includes a first arm. A first projection extends from the first arm. A first receiver extends from the first rear surface of the first panel. The first receiver is spaced apart from the first arm. The sign frame include a second panel including a second front surface disposed opposite a second rear surface. A second coupling assembly is integrally formed with the second panel. The second coupling assembly includes a second arm. The second coupling assembly is removably coupled to the first coupling assembly. A second projection extends from the second arm. The second projection is operatively received by the first receiver. A second receiver extends from the second rear surface of the second panel. The second receiver is spaced apart from the second arm. The second receiver operatively receives the first projection. The first panel operatively pivots with respect to the second panel, between a stowed position and a deployed position, about the first coupling assembly and the second coupling assembly that are removably coupled.

According to certain aspects of the present disclosure, a panel for a sign frame is provided. The panel includes a first surface. A second surface is disposed opposite the first surface. A first coupling assembly is integrally formed with the second surface. The first coupling assembly includes an arm. A projection extends from the arm. A receiver extends from the second surface and is spaced apart from the arm. A detent extends from the arm. A bump is disposed proximate the receiver. A first stop is recessed into the bump. The coupling assembly is configured to removably couple with a second coupling assembly integrally formed with another panel.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

Figure 1:
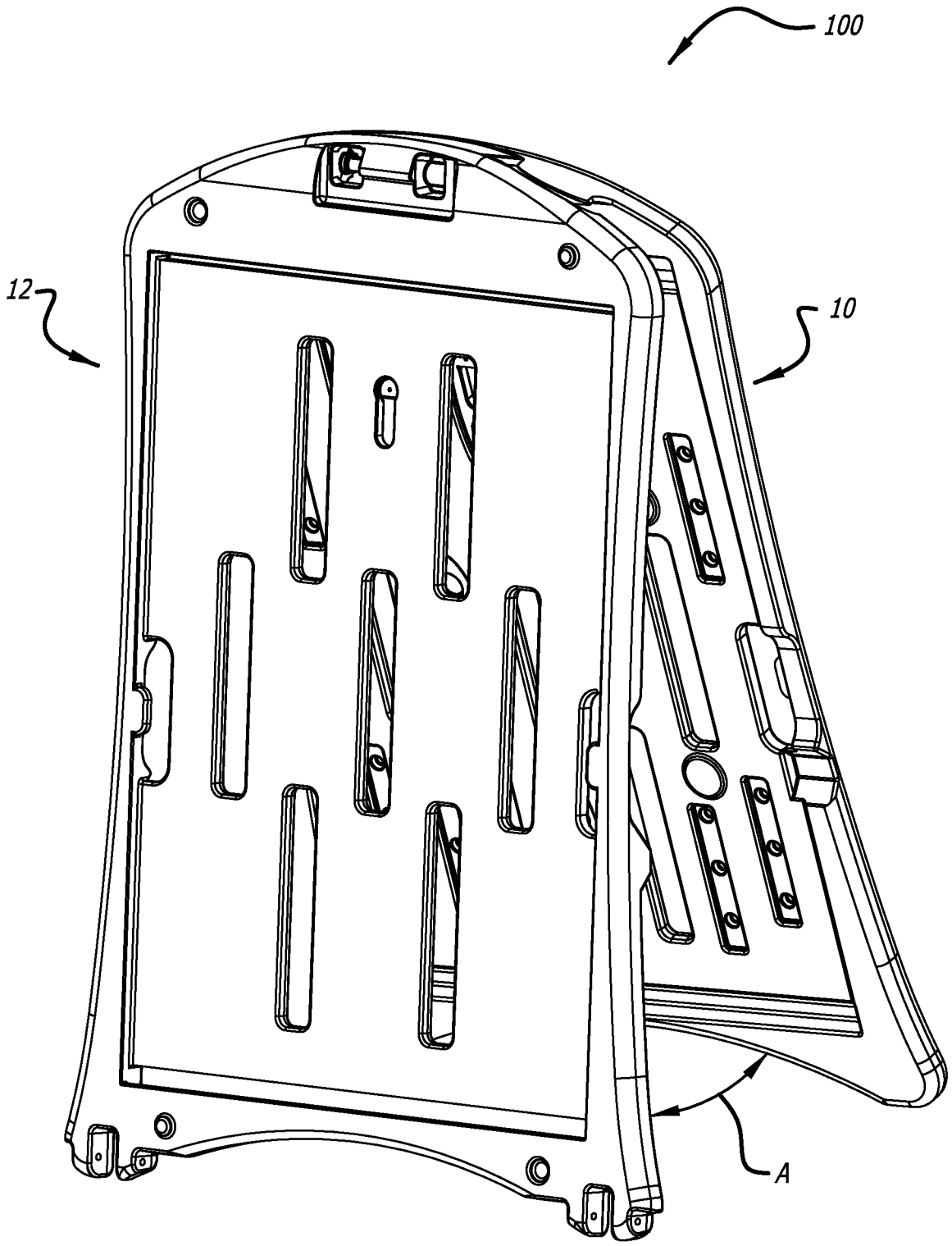
FIG. 1 is a perspective view of an example sign frame, in a deployed position, according to certain aspects of the disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

In addition, each of the drawings is a schematic diagram and thus is not necessarily strictly illustrated. In each of the drawings, substantially the same structural components are assigned with the same reference signs, and redundant descriptions will be omitted or simplified.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. For example, while the portable sign frames discussed herein may be implemented in many different forms, the disclosure will show in the drawings, and will herein describe in detail, implementations with the understanding that the present description is to be considered as an exemplification of the principles of the portable sign frame and is not intended to limit the broad aspects of the disclosure to the implementations illustrated. Accordingly, the drawings and description are to be regarded as illustrative in nature and not restrictive.

FIG. 1 illustrates an example sign frame 100 according to certain aspects of the disclosure. The sign frame 100 is illustrated in a deployed position. The sign frame 100 includes a first panel 10 and a second panel 12. In certain aspects, the first panel 10 and the second panel 12 are identical. In other aspects, the first panel 10 and the second panel 12 are nearly identical such that one panel may include a feature that the other panel does not include. The first panel 10 and the second panel 12 may be formed of any suitable material such as, but not limited to, molded plastic, plastic, metal, and other well-known materials in the industry. The first panel 10 and the second panel 12 can be formed by any suitable process such as, but not limited to, blow molding and other well-known processes in the industry. In certain aspects, the first panel 10 and the second panel 12 are blow molded plastic. It is understood that the dimensions of these elements are exemplary only, and other sizes and shapes are possible.

Referring to FIGS. 2-7, the first panel 10 is depicted in various views and will be describe in more detail below. The first panel 10 includes an upper side 14, a lower side 16, a first lateral side 18, a second lateral side 20, a first front surface 22, a first rear surface 24, and a chamber 26. The upper side 14 is disposed opposite the lower side 16. The first lateral side 18 is disposed opposite the second lateral side 20. The first lateral side 18 and the second lateral side 20 extend between the upper side 14 and the lower side 16.

The first front surface 22 and the first rear surface 24 are bounded by the upper side 14, the lower side 16, the first lateral side 18, and the second lateral side 20. The first front surface 22 is disposed opposite the first rear surface 24. The first front surface 22 and the first rear surface 24 are, at certain sections, spaced apart from each other such that the chamber 26 is disposed therebetween. The chamber 26 will be described in more detail below.

Figure 2:
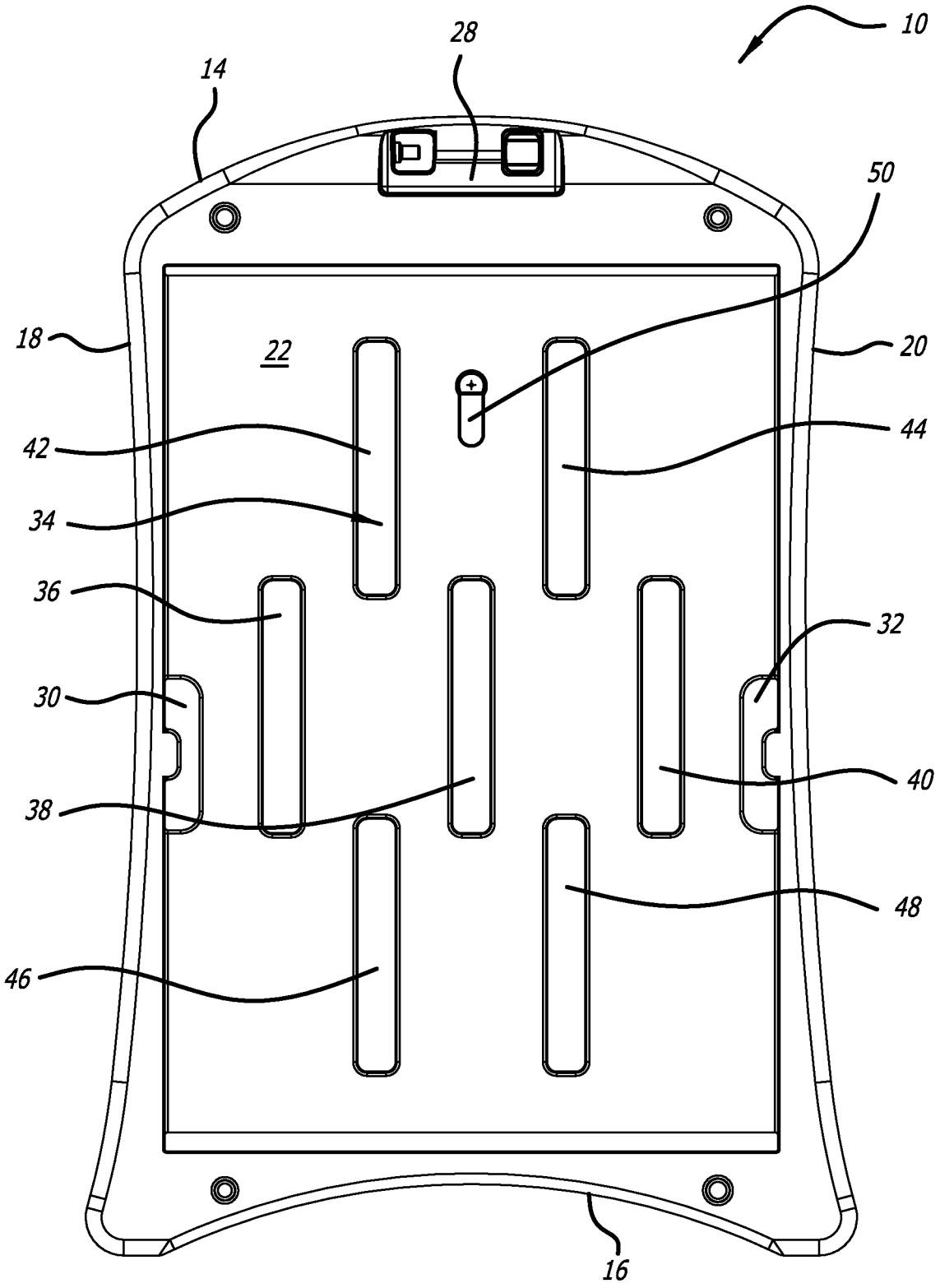
FIG. 2 is a front view of a first panel of the sign frame of FIG. 1, according to certain aspects of the disclosure.

With particular reference to FIG. 2, the first panel 10 includes a first grip 28 recessed into the first front surface 22 proximate the upper side 14. The first grip 28 can be contoured as a hand grip to facilitate transporting the sign frame 100. The first panel 10 includes a first handle cutout 30 and a second handle cutout 32. The first handle cutout 30 is proximate the first lateral side 18 and is disposed through the first front surface 22 and the first rear surface 24. The second handle cutout 32 is proximate the second lateral side 20 and is disposed through the first front surface 22 and the first rear surface 24. The first handle cutout 30 and the second handle cutout 32 are offset along the first lateral side 18 and the second lateral side 20, respectively, between the upper side 14 and the lower side 16 such that the first handle cutout 30 and the second handle cutout 32 are positioned closer towards the lower side 16 than the upper side 14.

The first panel 10 includes a plurality of slots 34 disposed through the first front surface 22 and the first rear surface 24. The plurality of slots 34 are strategically arranged through the first panel 10 and are configured to add structural strength to the first panel 10 as well as to reduce weight. In certain aspects, each slot of the plurality of slots 34 is rectangular in shape such that the length of the slot is arranged substantially parallel to the first lateral side 18 and the second lateral side 20. In such aspects, loading advantages are provided by arranging the length of the slot to be substantially parallel to the first lateral side 18 and the second lateral side 20. It should be understood, however, that the plurality of slots 34 can be of any shape such as, but not limited to, circle, oval, square, and triangle, to name a few shapes.

In certain aspects, the plurality of slots 34 are arranged such that a first slot 36, a second slot 38, and a third slot 40 are arranged between the upper side 14 and the lower side 16. The first slot 36, the second slot 38, and the third slot 40 are aligned with respect to each other between the first lateral side 18 and the second lateral side 20 such that the second slot 38 is arranged between the first slot 36 and the third slot 40. In such aspects, the plurality of slots 34 includes a fourth slot 42 and a fifth slot 44 aligned with respect to each other between the first lateral side 18 and the second lateral side 20. The fourth slot 42 and the fifth slot 44 are disposed in a region of the first panel 10 that is located substantially between the upper side 14 and the upper portions of the first slot 36, the second slot 38, and the third slot 40. Moreover, the plurality of slots 34 includes a sixth slot 46 and a seventh slot 48 aligned with respect to each other between the first lateral side 18 and the second lateral side 20. The sixth slot 46 and the seventh slot 48 are disposed in a region of the first panel 10 that is located substantially between the lower side 16 and lower portions of the first slot 36, the second slot 38, and the third slot 40. The fourth slot 42 and the sixth slot 46 are aligned with each other with respect to the upper side 14 and the lower side 16, and offsettingly intersperse the first slot 36 and the second slot 38. The fifth slot 44 and the seventh slot 48 are also aligned with each other with respect to the upper side 14 and the lower side 16, and offsettingly intersperse the second slot 38 and the third slot 40.

In certain aspects, the first panel 10 optionally includes a tether slot 50. The tether slot 50 is disposed through the first front surface 22 and the first rear surface 24. The tether slot 50 can be arranged between the fourth slot 42 and the fifth slot 44. The tether slot 50 is configured to receive and secure a tether (not shown) to assist in stability of the sign frame 100.

Figure 3:
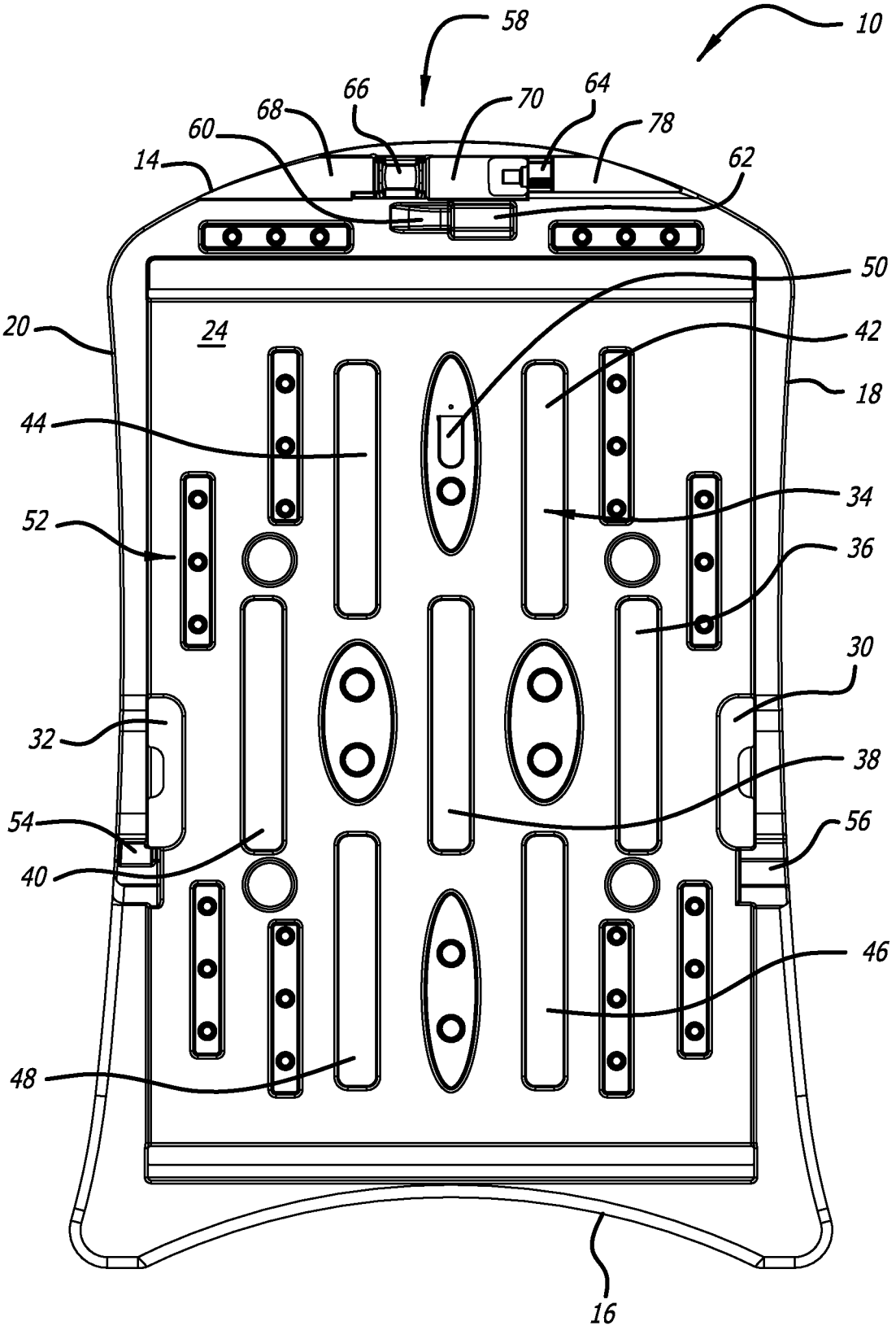
FIG. 3 is a rear view of the first panel of the sign frame of FIG. 1, according to certain aspects of the disclosure.
Figure 4:
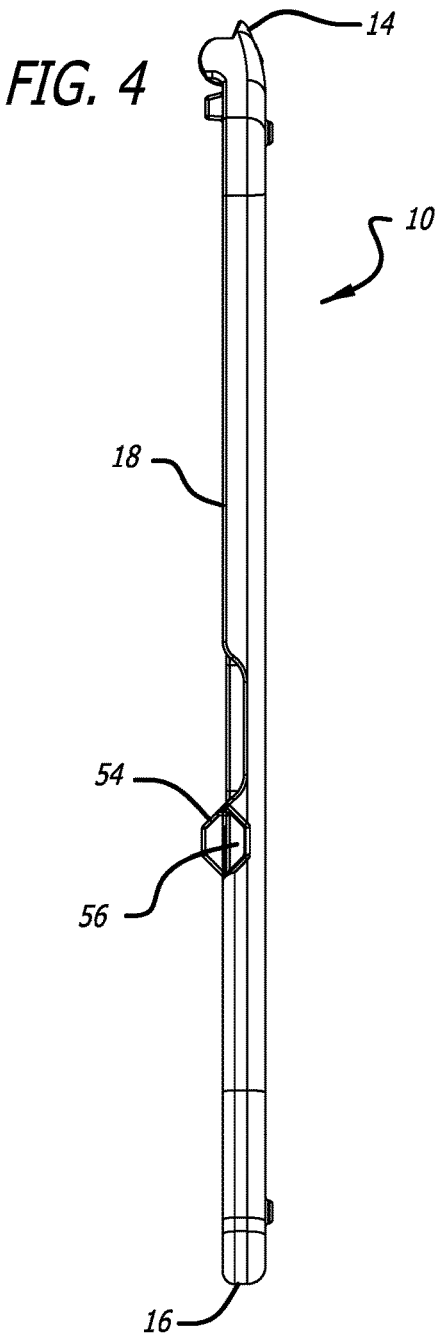
FIG. 4 is left side view of the first panel of the sign frame of FIG. 1, according to certain aspects of the disclosure.
Figure 5:
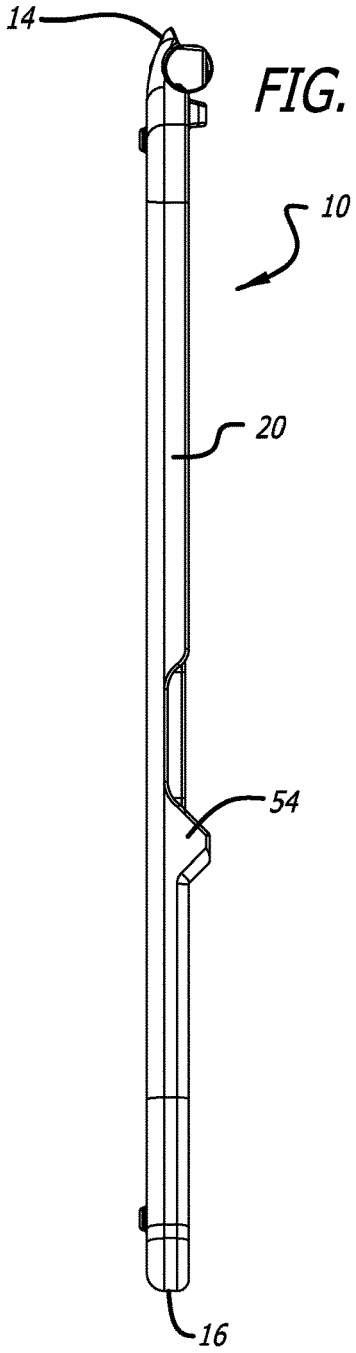
FIG. 5 is a right side view of the first panel of the sign frame of FIG. 1, according to certain aspects of the disclosure.
Figure 6:
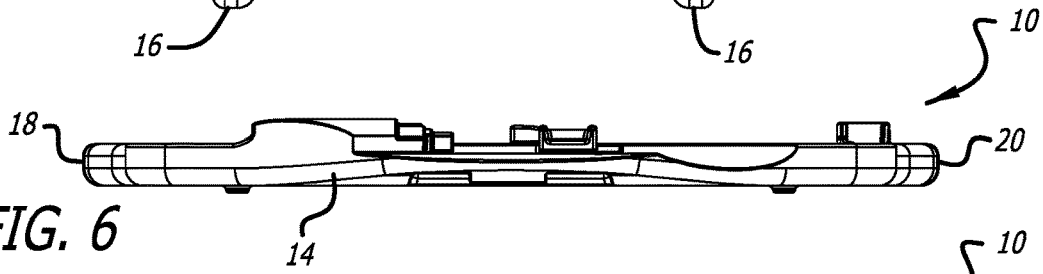
FIG. 6 is a top view of the first panel of the sign frame of FIG. 1, according to certain aspects of the disclosure.
Figure 7:
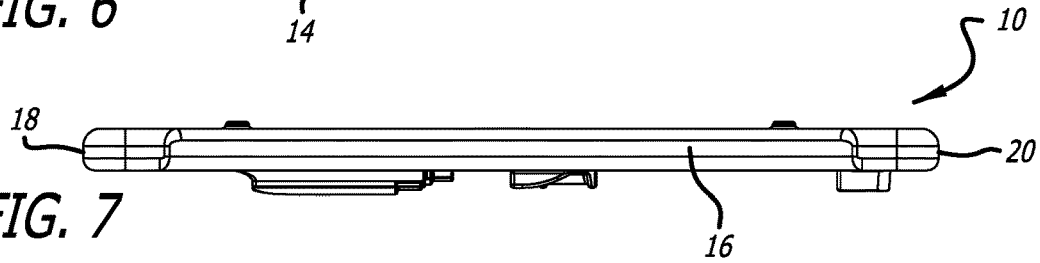
FIG. 7 is a bottom view of the first panel of the sign frame of FIG. 1, according to certain aspects of the disclosure.

With reference to FIG. 3, the first panel 10 includes a plurality of coring features 52 disposed therethrough that are configured to add rigidity to the first panel 10. In certain aspects, the plurality of coring features 52 are of non-uniform shape. In certain aspects, some coring features of the plurality of coring features 52 intersperse some of the slots of the plurality of slots 34.

Figure 16:
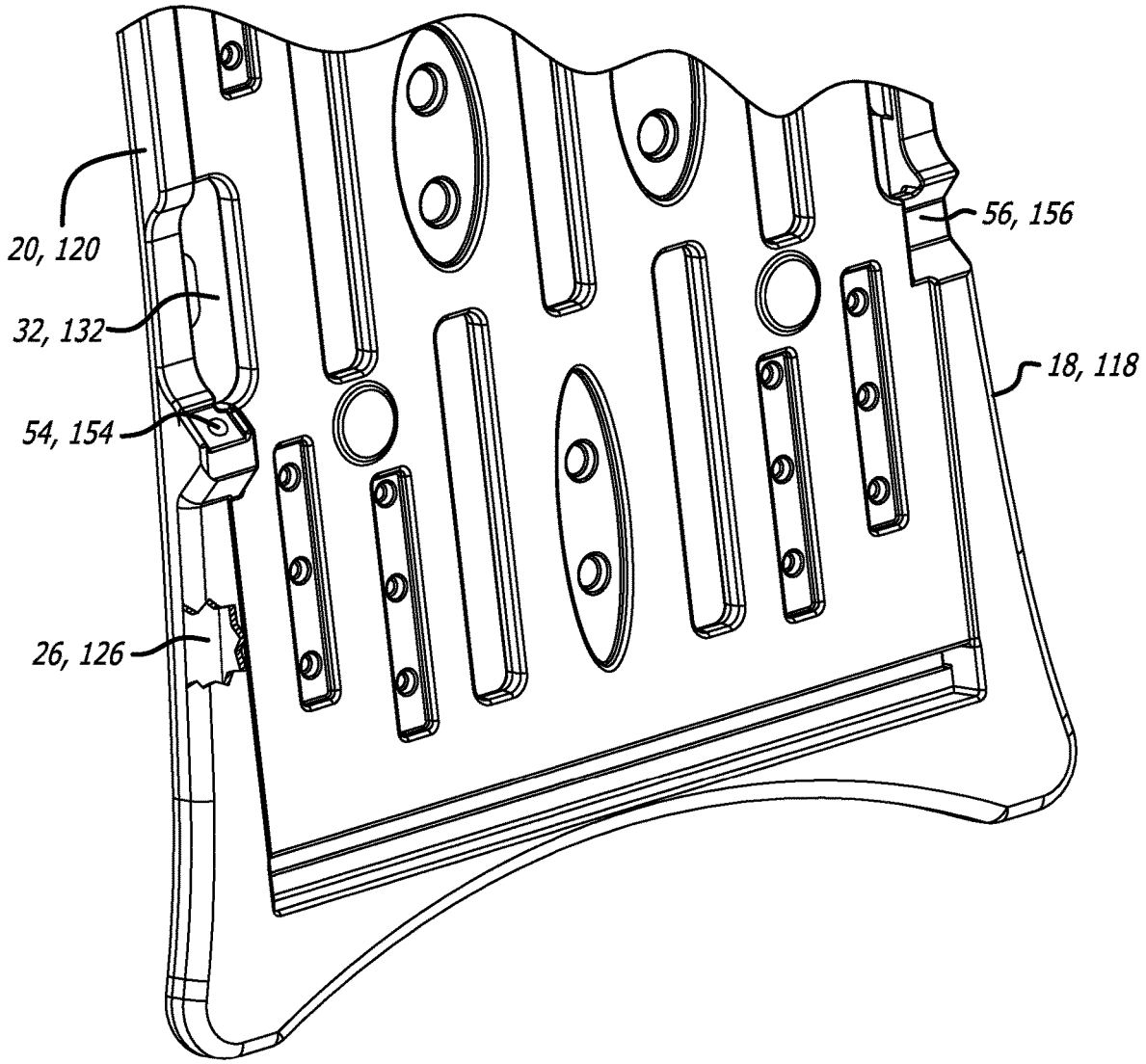
FIG. 16 is a perspective view illustrating a port of the sign frame of FIG. 1, according to certain aspects of the disclosure.

Referring to FIGS. 3 and 16, the first panel 10 includes a first port 54 protruding from the first rear surface 24. The first port 54 is in fluid communication with the chamber 26. While the first port 54 is shown as proximate to the second lateral side 20 and the second handle cutout 32, the first port 54 can instead be alternatively disposed proximate the first lateral side 18 and the first handle cutout 30. The first port 54 is configured to receive ballast such as, but not limited to, sand, stones, pellets, and other well-known weighted materials, to store within the chamber 26 to add stability and weight to the sign frame 100. For example, with the first port 54 disposed between the second handle cutout 32 and the lower side 16 (e.g., in lower third region of the first panel 10), the ballast can be evenly distributed within the chamber 26, as opposed to other ports that are disposed in the upper regions of the panel, and increase weight of the sign frame 100.

Figure 17:
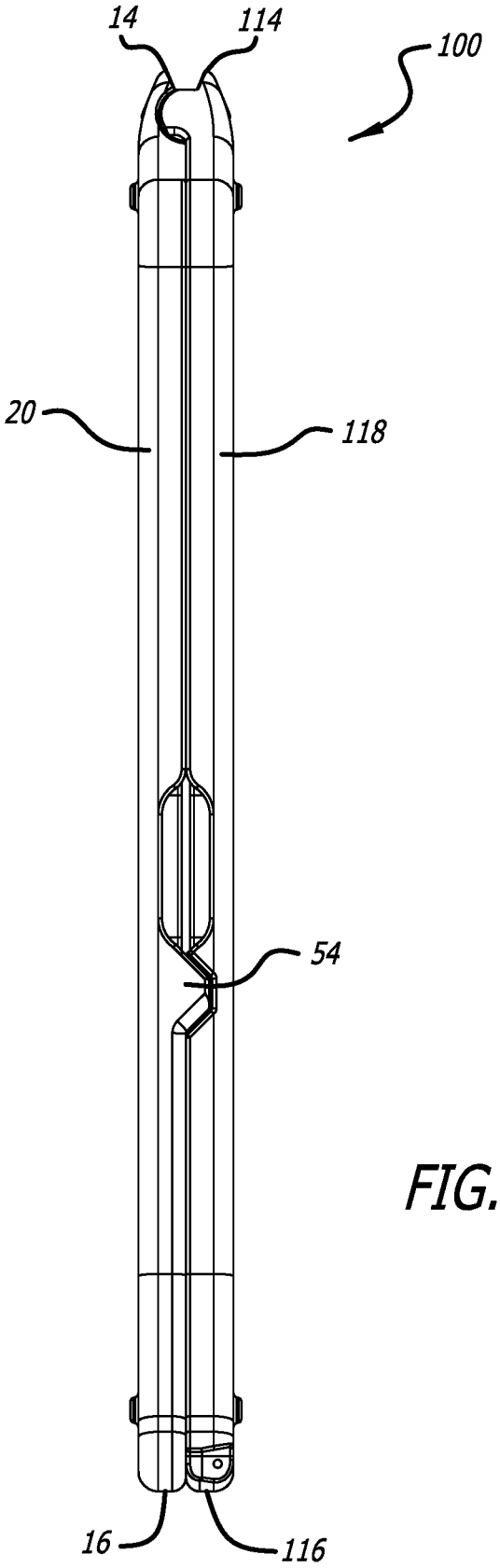
FIG. 17 is side view of the sign frame of FIG. 1 in a stowed position, according to certain aspects of the disclosure.

The first panel 10 includes a first seat 56 recessed into the first rear surface 24 for receiving a second port 154 of the second panel 12 when the sign frame 100 is in a stowed position, as illustrated in FIG. 17 and described in more detail below. When the first port 54 is disposed proximate to the second lateral side 20 and the second handle cutout 32 the first seat 56 is disposed proximate to the first lateral side 18 and the first handle cutout 30. Alternatively, when the first port 54 is disposed proximate to the first lateral side 18 and the first handle cutout 30 the first seat 56 is disposed proximate to the second lateral side 20 and the second handle cutout 32.

Figure 14:
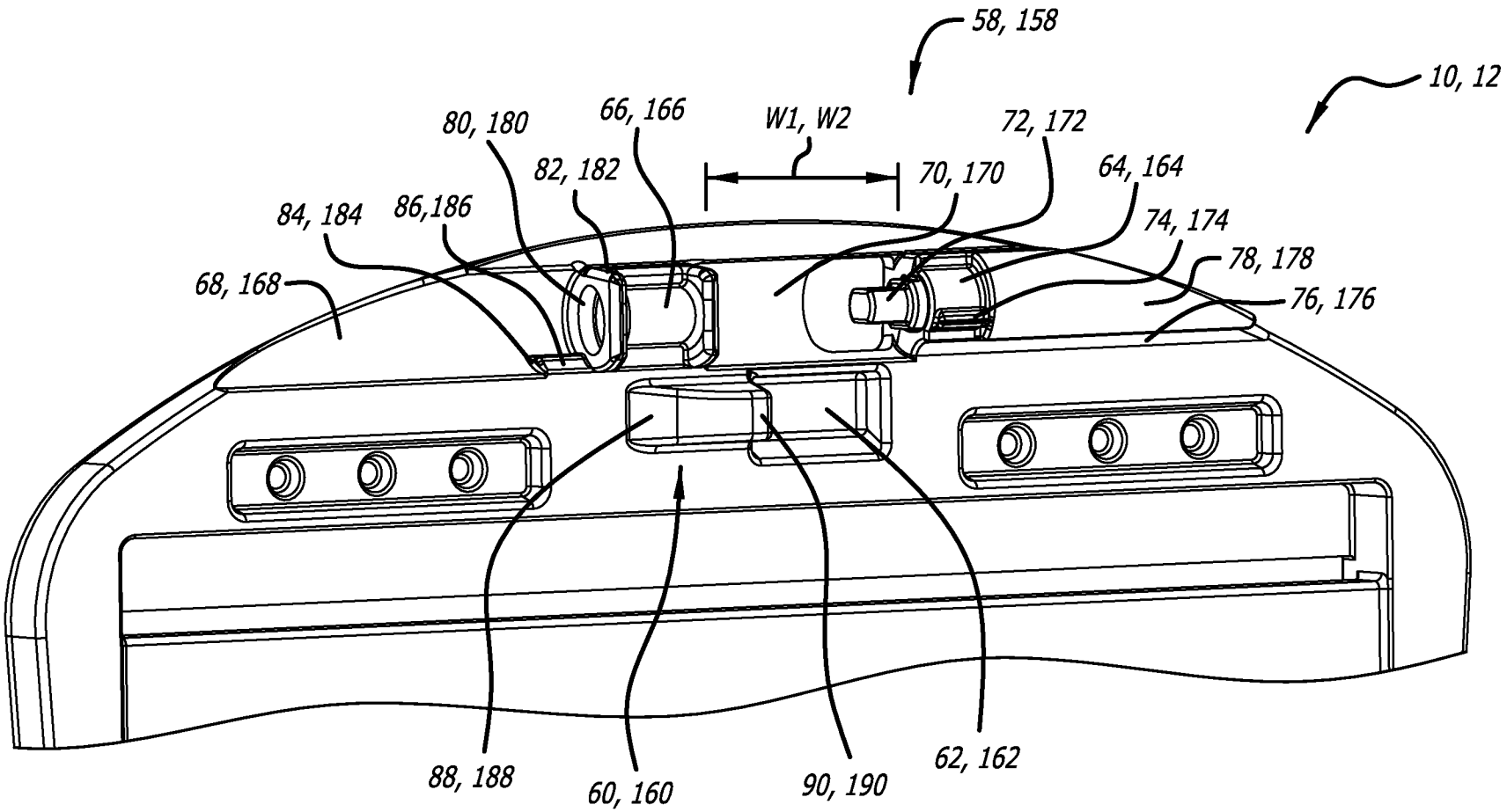
FIG. 14 is a detailed view illustrating a coupling assembly of the first panel or the second panel of the sign frame of FIG. 1, according to certain aspects of the disclosure.

Referring to FIGS. 3 and 14, the first panel 10 includes a first coupling assembly 58, a first anti-disassembly protrusion 60, and a first anti-disassembly indent 62. In certain aspects, the first coupling assembly 58 is integrally formed with the first panel 10. The first coupling assembly 58 includes a first arm 64 and a first receiver 66. The first arm 64 and the first receiver 66 extend outwardly from a first channel 68 recessed in the first rear surface 24 and proximate the upper side 14. The first arm 64 is spaced apart from the first receiver 66 by a first distance W1 defining a first gap 70 therebetween.

The first arm 64 includes a first projection 72, a first detent 74, a first groove 76, and a first arm profile 78. The first projection 72 extends from the first arm 64 towards the first receiver 66. The first detent 74 extends outwardly from the first arm 64 and is disposed between the first projection 72 and the first arm profile 78. The first groove 76 is recessed into the first arm 64 along an intersection of the first arm 64 and the first channel 68.

The first receiver 66 is configured to receive a second projection 172 of the second panel 12. In particular, the first receiver 66 includes a first aperture 80 disposed therethrough to receive the second projection 172 of the second panel 12. The first receiver 66 includes a first exterior profile 82. The first exterior profile 82 is contoured to be received by a second gap 170 of the second panel 12.

A first bump 84 extends from, and partially resides in, the first channel 68 proximate the first receiver 66 and is separated from the first gap 70 by the first receiver 66. A first stop 86 is recessed into the first bump 84 and is configured to receive a second detent 174 of the second panel 12 when the sign frame 100 is in the deployed position. The first bump 84 is configured to be received by a second groove 176 of the second panel 12 when the sign frame 100 is in the stowed position.

The first anti-disassembly protrusion 60 extends from the first rear surface 24 of the first panel 10. The first anti-disassembly indent 62 is recessed into the first rear surface 24 adjacent the first anti-disassembly protrusion 60. The first anti-disassembly protrusion 60 and the first anti-disassembly indent 62 are disposed proximate the first channel 68. When the sign frame 100 is in the stowed position, the first anti-disassembly protrusion 60 is received by the second anti-disassembly indent 162 of the second panel 12 and the first anti-disassembly indent 62 is configured to receive the second anti-disassembly protrusion 160 of the second panel 12.

Figure 15:
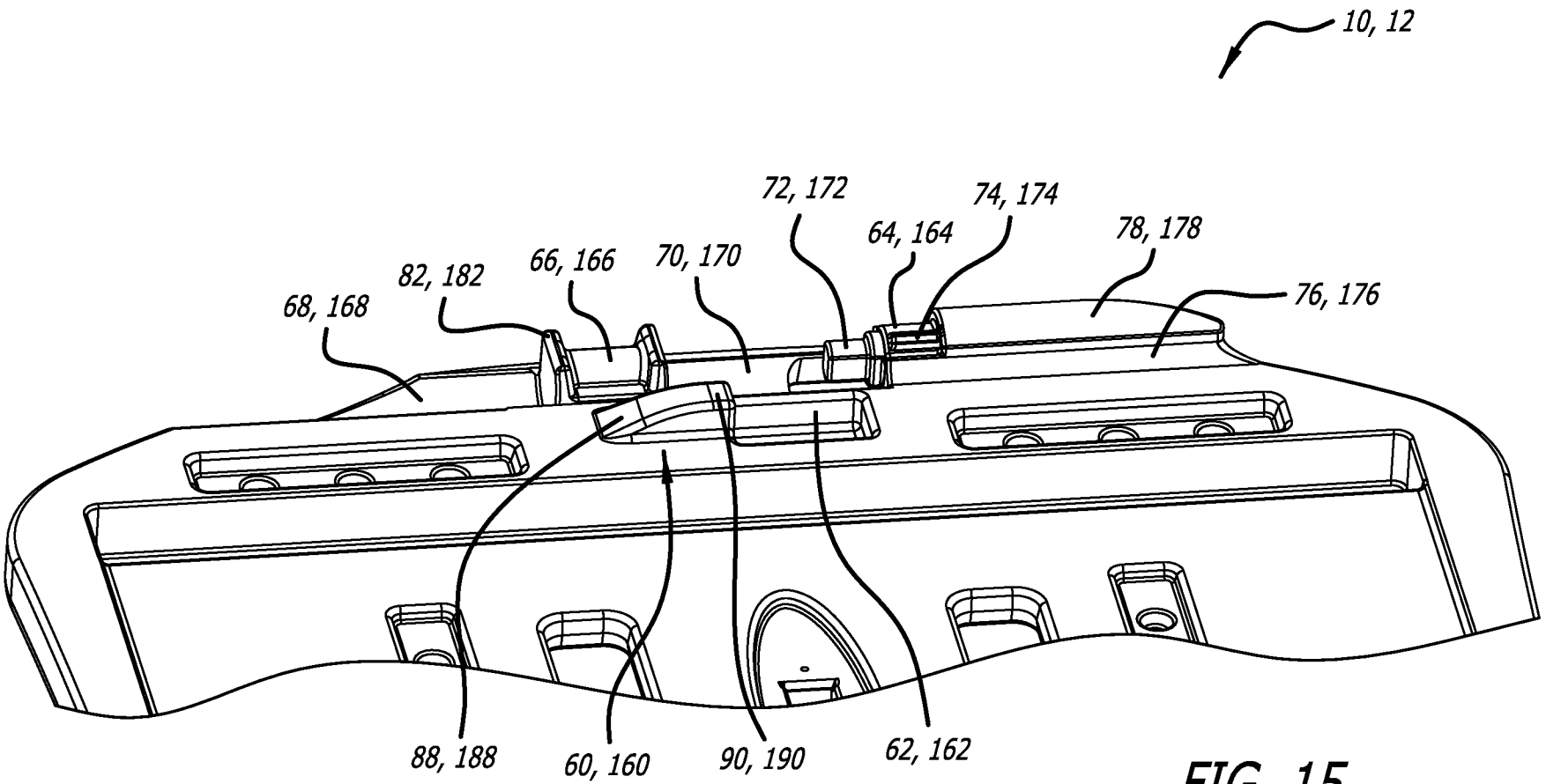
FIG. 15 is a perspective view illustrating an anti-disassembly protrusion and an anti-disassembly indent of the first panel or the second panel of the sign frame of FIG. 1, according to certain aspects of the disclosure.

With reference to FIGS. 14 and 15, in certain aspects, the first anti-disassembly protrusion 60 includes a first protrusion slope 88 and a first plateau 90. In such aspects, the first protrusion slope 88 extends from the first rear surface 24 of the first panel 10 at a gradual incline towards the first anti-disassembly indent 62 and transitions into the first plateau 90.

Referring to FIGS. 8-13, the second panel 12 is depicted in various views and will be described in more detail below. The second panel 12 includes an upper side 114, a lower side 116, a first lateral side 118, a second lateral side 120, a second front surface 122, a second rear surface 124, and a chamber 126. The upper side 114 is disposed opposite the lower side 116. The first lateral side 118 is disposed opposite the second lateral side 120. The first lateral side 118 and the second lateral side 120 extend between the upper side 114 and the lower side 116.

The second front surface 122 and the second rear surface 124 are bounded by the upper side 114, the lower side 116, the first lateral side 118, and the second lateral side 120. The second front surface 122 is disposed opposite the second rear surface 124. The second front surface 122 and the second rear surface 124 are, at certain sections, spaced apart from each other such that the chamber 126 is disposed therebetween.

Figure 8:
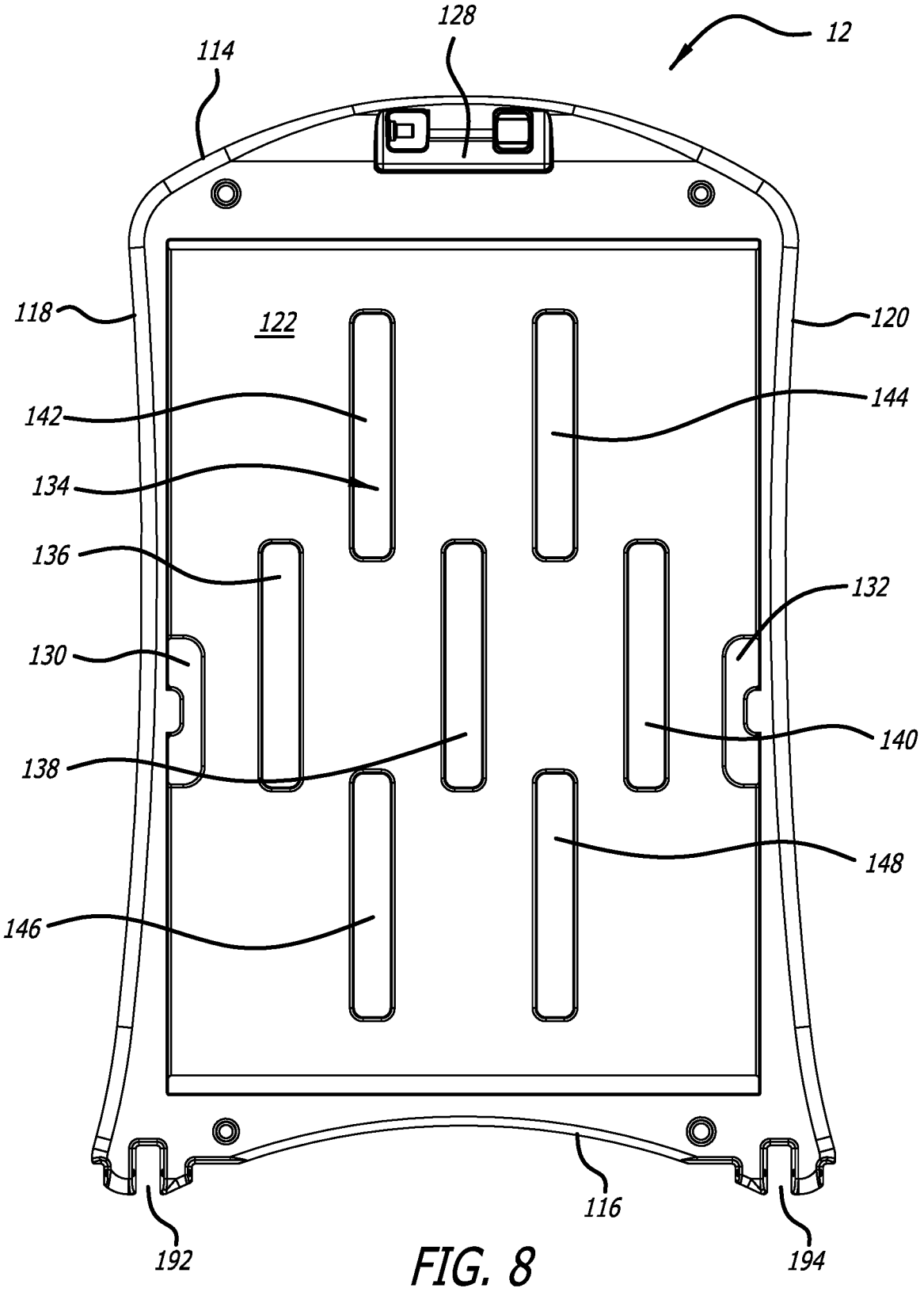
FIG. 8 is a front view of a second panel of the sign frame of FIG. 1, according to certain aspects of the disclosure.

With particular reference to FIG. 8, the second panel 12 includes a first grip 128 recessed into the second front surface 122 proximate the upper side 114. The first grip 128 can be contoured as a hand grip to facilitate transporting the sign frame 100. The second panel 12 includes a first handle cutout 130 and a second handle cutout 132. The first handle cutout 130 is proximate the first lateral side 118 and is disposed through the second front surface 122 and the second rear surface 124. The second handle cutout 132 is proximate the second lateral side 120 and is disposed through the second front surface 122 and the second rear surface 124. The first handle cutout 130 and the second handle cutout 132 are offset along the first lateral side 118 and the second lateral side 120, respectively, between the upper side 114 and the lower side 116 such that the first handle cutout 130 and the second handle cutout 132 are positioned closer towards the lower side 116 than the upper side 114. When the sign frame 100 is in the stowed position the first handle cutout 30 of the first panel 10 aligns with the second handle cutout 132 of the second panel 12, and the second handle cutout 32 of the first panel 10 aligns with the first handle cutout 130 of the second panel 12.

The second panel 12 includes a plurality of slots 134 disposed through the second front surface 122 and the second rear surface 124. The plurality of slots 134 are strategically arranged through the second panel 12 and are configured to add structural strength to the second panel 12 as well as to reduce weight. In certain aspects, each slot of the plurality of slots 134 is rectangular in shape such that the length of the slot is arranged substantially parallel to the first lateral side 118 and the second lateral side 120. In such aspects, loading advantages are provided by arranging the length of the slot to be substantially parallel to the first lateral side 118 and the second lateral side 120. It should be understood, however, that the plurality of slots 134 can be of any shape such as, but not limited to, circle, oval, square, and triangle, to name a few shapes.

In certain aspects, the plurality of slots 134 are arranged such that a first slot 136, a second slot 138, and a third slot 140 are arranged between the upper side 114 and the lower side 116. The first slot 136, the second slot 138, and the third slot 140 are aligned with respect to each other between the first lateral side 118 and the second lateral side 120 such that the second slot 138 is arranged between the first slot 136 and the third slot 140. In such aspects, the plurality of slots 134 includes a fourth slot 142 and a fifth slot 144 aligned with respect to each other between the first lateral side 118 and the second lateral side 120. The fourth slot 142 and the fifth slot 144 are disposed in a region of the second panel 12 that is located substantially between the upper side 114 and the upper portions of the first slot 136, the second slot 138, and the third slot 140. Moreover, the plurality of slots 134 includes a sixth slot 146 and a seventh slot 148 aligned with respect to each other between the first lateral side 118 and the second lateral side 120. The sixth slot 146 and the seventh slot 148 are disposed in a region of the second panel 12 that is located substantially between the lower side 116 and lower portions of the first slot 136, the second slot 138, and the third slot 140. The fourth slot 142 and the sixth slot 146 are aligned with each other with respect to the upper side 114 and the lower side 116, and offsettingly intersperse the first slot 136 and the second slot 138. The fifth slot 144 and the seventh slot 148 are also aligned with each other with respect to the upper side 114 and the lower side 116, and offsettingly intersperse the second slot 138 and the third slot 140.

Figure 9:
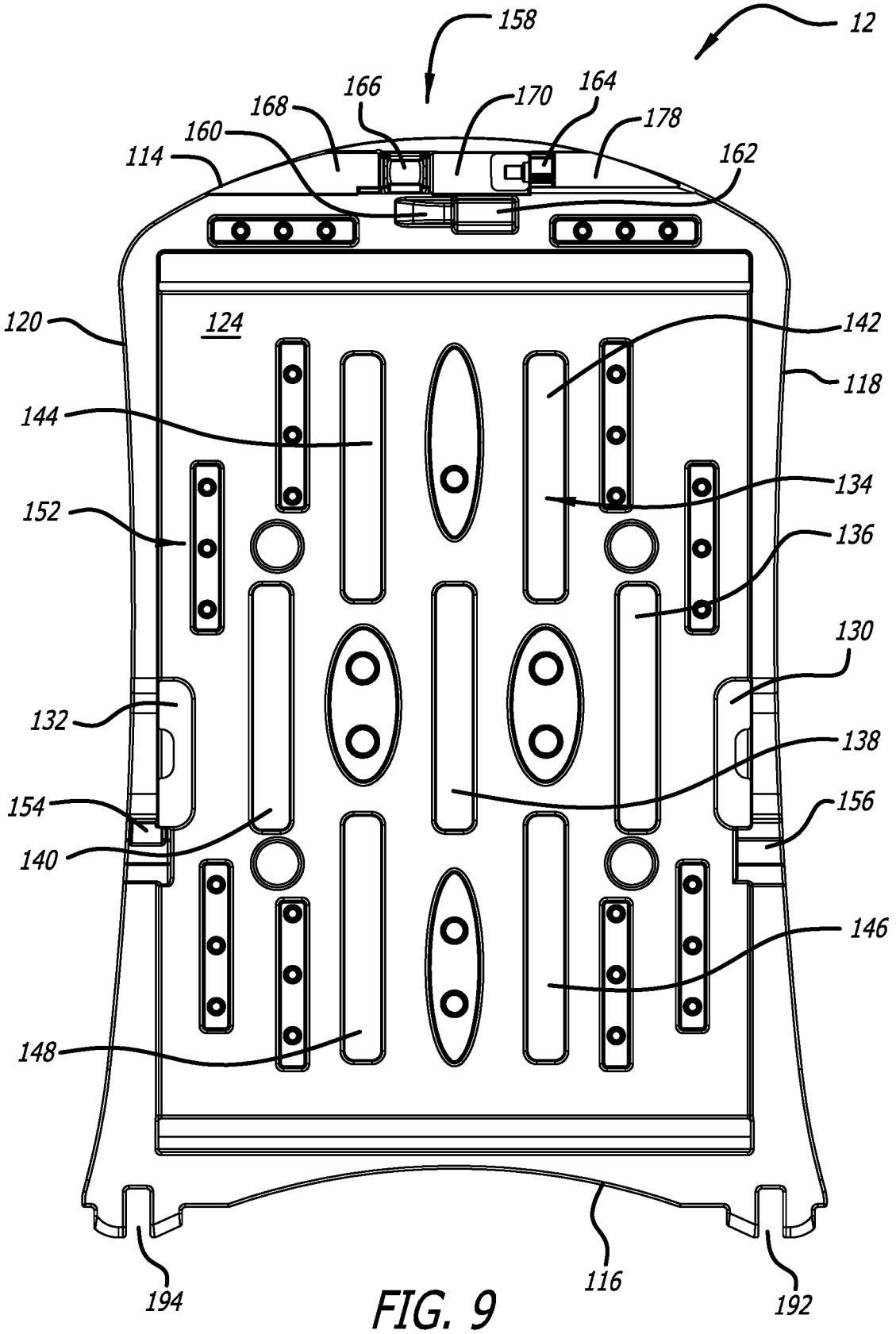
FIG. 9 is a rear view of the second panel of the sign frame of FIG. 1, according to certain aspects of the disclosure.
Figure 10:
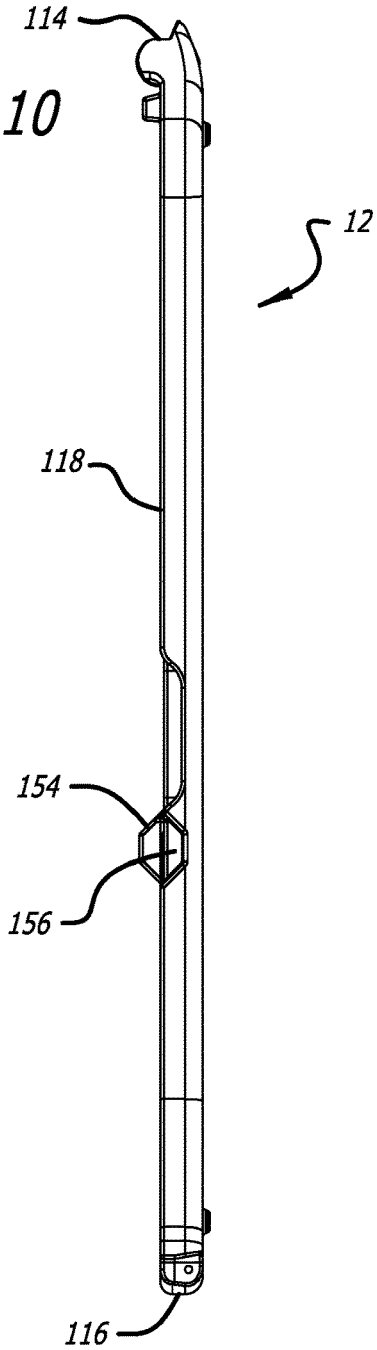
FIG. 10 is left side view of the second panel of the sign frame of FIG. 1, according to certain aspects of the disclosure.
Figure 11:
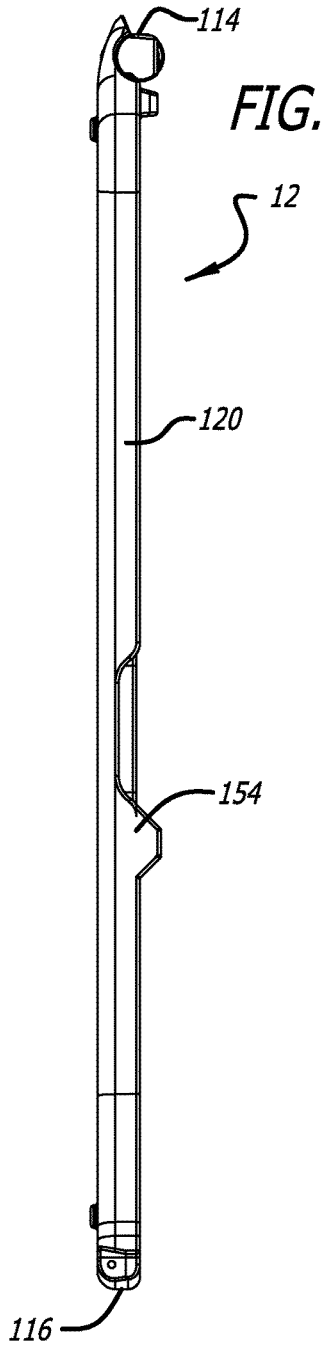
FIG. 11 is a right side view of the second panel of the sign frame of FIG. 1, according to certain aspects of the disclosure.
Figure 12:
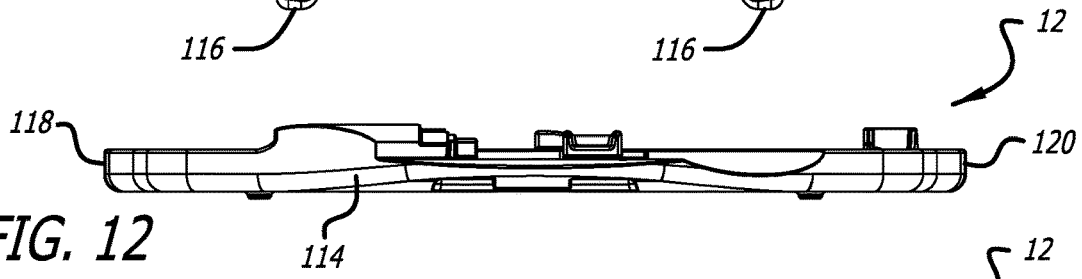
FIG. 12 is a top view of the second panel of the sign frame of FIG. 1, according to certain aspects of the disclosure.
Figure 13:
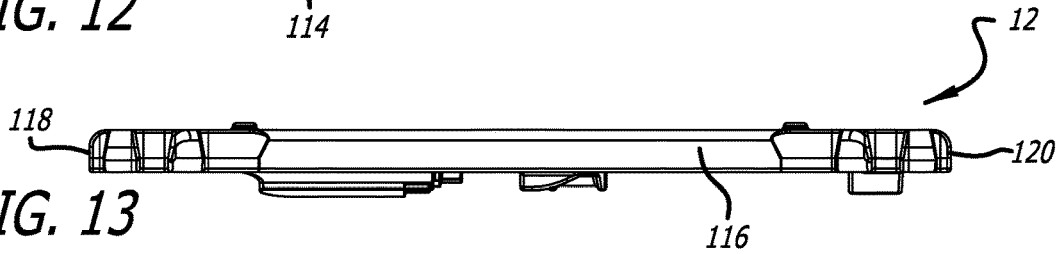
FIG. 13 is a bottom view of the second panel of the sign frame of FIG. 1, according to certain aspects of the disclosure.

With reference to FIG. 9, the second panel 12 includes a plurality of coring features 152 disposed therethrough that are configured to add rigidity to the second panel 12. In certain aspects, the plurality of coring features 152 are of non-uniform shape from each other. In certain aspects, some coring features of the plurality of coring features 152 intersperse some of the slots of the plurality of slots 134.

Referring to FIGS. 9 and 16, the second panel 12 includes a second port 154 protruding from the second rear surface 124. The second port 154 is in fluid communication with the chamber 126. While the second port 154 is shown as proximate to the second lateral side 120 and the second handle cutout 132, the second port 154 can instead be alternatively disposed proximate the first lateral side 118 and the first handle cutout 130. The second port 154 is configured to receive ballast such as, but not limited to, sand, stones, pellets, and other well-known weighted materials, to store within the chamber 126 to add stability and weight to the sign frame 100. For example, with the second port 154 disposed between the second handle cutout 132 and the lower side 116 (e.g., in lower third region of the second panel 12), the ballast can be evenly distributed within the chamber 126, as opposed to other ports that are disposed in the upper regions of the panel, and increase weight of the sign frame 100.

The second panel 12 includes a second seat 156 recessed into the first rear surface 24 for receiving a second port of the second panel 12 when the sign frame 100 is in a stowed position, as illustrated in FIG. 17 and described in more detail below. When the second port 154 is disposed proximate to the second lateral side 120 and the second handle cutout 132 the second seat 156 is disposed proximate to the first lateral side 118 and the first handle cutout 130. Alternatively, when the second port 154 is disposed proximate to the first lateral side 118 and the first handle cutout 130 the second seat 156 is disposed proximate to the second lateral side 120 and the second handle cutout 132. In either aspect, when the sign frame 100 is in the stowed position, the second port 154 is configured to be matingly received by the first seat 56 of the first panel 10 while the first port 54 of the first panel 10 is matingly received by the second seat 156 of the second panel 12.

Referring to FIGS. 9 and 14, the second panel 12 includes a second coupling assembly 158, a second anti-disassembly protrusion 160, and a second anti-disassembly indent 162. In certain aspects, the second coupling assembly 158 is integrally formed with the second panel 12. The second coupling assembly 158 includes a second arm 164 and a second receiver 166. The second arm 164 and the second receiver 166 extend outwardly from a second channel 168 recessed in the second rear surface 124 and proximate the upper side 114. The second arm 164 is spaced apart from the second receiver 166 by a second distance W2 defining a second gap 170 therebetween.

The second arm 164 includes a second projection 172, a second detent 174, a second groove 176, and a second arm profile 178. The second projection 172 extends from the second arm 164 towards the second receiver 166. The second detent 174 extends outwardly from the second arm 164 and is disposed between the second projection 172 and the second arm profile 178. The second groove 716 is recessed into the second arm 164 along an intersection of the second arm 164 and the second channel 168.

The second receiver 166 is configured to receive the first projection 72 of the first panel 10. In particular, the second receiver 166 includes a second aperture 180 disposed therethrough to receive the first projection 72 of the first panel 10. The second receiver 166 includes a second exterior profile 182. The second exterior profile 182 is contoured to be received by the first gap 70 of the first panel 10.

A second bump 184 extends from, and partially resides in, the second channel 168 proximate the second receiver 166 and is separated from the second gap 170 by the second receiver 166. A second stop 186 is recessed into the second bump 184 and is configured to receive the first detent 74 of the first panel 10 when the sign frame 100 is in the deployed position. The second bump 184 is configured to be received by the first groove 76 of the first panel 10 when the sign frame 100 is in the stowed position.

The second anti-disassembly protrusion 160 extends from the second rear surface 124 of the second panel 12. The second anti-disassembly indent 162 is recessed into the second rear surface 124 adjacent the second anti-disassembly protrusion 160. The second anti-disassembly protrusion 160 and the second anti-disassembly indent 162 are disposed proximate the second channel 168. When the sign frame 100 is in the stowed position, the second anti-disassembly protrusion 160 is received by the first anti-disassembly indent 62 of the first panel 10 and the second anti-disassembly indent 162 is configured to receive the first anti-disassembly protrusion 60 of the first panel 10.

With reference to FIGS. 14 and 15, in certain aspects, the second anti-disassembly protrusion 160 includes a second protrusion slope 188 and a second plateau 190. In such aspects, the first protrusion slope 88 extends from the first rear surface 24 of the first panel 10 at a gradual incline towards the first anti-disassembly indent 62 and transitions into the first plateau 90.

Referring back to FIGS. 8 and 9, in certain aspects, the second panel 12 includes a first wheel passage 192 and a second wheel passage 194. The first wheel passage 192 and the second wheel passage 194 are configured to receive and operably secure wheels (not shown) to facilitate transport of the sign frame 100 when in the stowed position. The first wheel passage 192 can be disposed proximate an intersection of the first lateral side 118 and the lower side 116 while the second wheel passage 194 can be disposed proximate an intersection of the second lateral side 120 and the lower side 116.

The first panel 10 and the second panel 12 can be assembled together to form the sign frame 100. Once the first panel and the second panel 12 are assembled, the sign frame 100 is foldable between the stowed position and the deployed position such that the first panel 10 and the second panel 12 are rotatable about the first coupling assembly 58 and the second coupling assembly 158, which are removably and operatively coupled to each other. For example, during assembly, the first rear surface 24 of the first panel 10 is positioned facing the second rear surface 124 of the second panel 12 and offset such that the first lateral side 18 and the second lateral side 20 of the first panel 10 are unaligned with the second lateral side 120 and the first lateral side 118 of the second panel 12, respectively. In this position, the first coupling assembly 58 of the first panel 10 and the second coupling assembly 158 of the second panel 12 are arranged so that the first channel 68 of the first panel 10 partially receives the second arm profile 178 of the second panel 12 while the first gap 70 of the first panel 10 receives the second receiver 166 of the second panel 12. In a similar manner, the second channel 168 of the second panel 12 partially receives the first arm profile 78 of the first panel 10 while the second gap 710 of the second panel 12 receives the first receiver 66 of the first panel 10.

In order to complete the assembly of the sign frame 100, the first panel 10 and the second panel 12 are slid into alignment with respect to each other such that the first coupling assembly 58 and the second coupling assembly 158 are removably and operatively coupled to each other. For example, the first panel 10 and the second panel 12 are forcibly aligned such that the first aperture 80 of the first receiver 66 operationally receives the second projection 172 of the second arm 164 and the second aperture 180 of the second receiver 166 operationally receives the first projection 72 of the first arm 64. Further, the alignment of the first panel 10 with the second panel 12 allows the first channel 68 to operationally receive the second arm profile 178 in full while also allowing the second channel 168 to operationally receive the first arm profile 78 in full. The alignment of the first panel 10 with the second panel 12 also forces the first anti-disassembly protrusion 60 into operational engagement with the second anti-disassembly indent 162 and the second anti-disassembly protrusion 160 into operational engagement with the first anti-disassembly indent 62. The combined operational interactions of the first anti-disassembly protrusion 60 with the second anti-disassembly indent 162 and the second anti-disassembly protrusion 160 with the first anti-disassembly indent 62 prevents the sign frame 100 from being disassembly until a predetermined disassembly threshold degree of force is applied to the first panel 10 and the second panel 12 when in the deployed position.

In this assembled state and stowed position, the first groove 76 of the first panel 10 receives the second bump 184 of the second panel 12 and the second groove 176 of the second panel 12 receives the first bump 84 of the first panel 10 to secure the sign frame 100 in the stowed position. Further, as illustrated in FIG. 17, the second seat 156 correspondingly receives the first port 54 of the first panel 10 in seated engagement when in the stowed position. Similarly, the first seat 56 correspondingly receives the second port 154 of the second panel 12 in seated engagement when in the stowed position.

From the stowed position, the sign frame 100 can be transitioned to the deployed position (see FIG. 1) by applying a predetermined expansion threshold degree of force to pivotally unfold the first panel 10 from the second panel 12. As the sign frame 100 transitions from the stowed position to the deployed position, the first panel 10 and the second panel 12 pivot about the first coupling assembly 58 and the second coupling assembly 158, which are removably coupled, such that the lower side 16 of the first panel 10 spreads away from the lower side 116 of the second panel 12. More particularly, as the sign frame 100 transitions from the stowed position to the deployed position, the first projection 72 operationally rotates within the second aperture 180 of the second receiver 166 and the second projection 172 operationally rotates within the first aperture 80 of the first receiver 66 causing the first bump 84 to disengage from the second groove 176 and the second bump 184 to disengage from the first groove 76. The sign frame 100 continues to transition to the deployed position until the first panel 10 is pivotally spread away from the second panel 12 to reach a predetermined angle A (see FIG. 1) therebetween such that the first detent 74 is retained in the second stop 186 of the second bump 184 and the second detent 174 is retained in the first stop 86 of the first bump 84 to maintain the sign frame 100 in the deployed position. The predetermined angle A is an acute angle. In certain aspects, the predetermine angle A is in the range of 30 degrees to 44 degrees. In certain aspects, the predetermined angle A is 35 degrees.

From the deployed position, the sign frame 100 can then be transitioned back to the stowed position by applying a predetermined collapsing threshold degree of force to fold the first panel 10 towards the second panel 12 about the first coupling assembly 58 and the second coupling assembly 158, which are removably coupled. By applying the predetermine collapsing threshold degree of force to the first panel 10 and the second panel 12, the first detent 74 is forcibly unseated from the second stop 186 and the second detent 174 is forcibly unseated from the first stop 86 allowing the first panel 10 and the second panel 12 to pivot about the first coupling assembly 58 and the second coupling assembly 158, which are removably coupled, such that the lower side 16 of the first panel 10 moves towards the lower side 116 of the second panel 12 until reaching the stowed position. As detailed above, in the stowed position, the first handle cutout 30 of the first panel 10 aligns with the second handle cutout 132 of the second panel 12, and the second handle cutout 32 of the first panel 10 aligns with the first handle cutout 130 of the second panel 12. The sign frame 100 can be transported by lifting either the first handle cutout 30 with the second handle cutout 132 or the second handle cutout 32 with the first handle cutout 130. The strategic offsetting of the handle cutouts 30, 32, 130, 132 provides for balanced carrying of the sign frame 100 even with the chamber 26 of the first panel 10 and the chamber 126 of the second panel 12 being filled with ballast. In certain aspects, the sign frame 100 can additionally or optionally be transported by positioning the second panel 12 and the wheels toward the ground surface and using either the first grip 28 of the first panel 10 or the first grip of the second panel 12 to pull the sign frame 100.

The sign frame 100 can also be disassembled from the deployed position. For example, the predetermined disassembly threshold degree of force is applied to the first panel 10 and the second panel 12 to further spread the lower side 16 of the first panel 10 away from the lower side 116 of the second panel 12 and increase the predetermined angle A. Once the predetermined angle A exceeds a threshold angle, the first anti-disassembly protrusion 60 will disengage from the second anti-disassembly indent 162 and the second anti-disassembly protrusion 160 disengage from the first anti-disassembly indent 62 allowing the first coupling assembly 58 to uncouple from the second coupling assembly 158. As an example, when the predetermine angle A is 35 degrees, a threshold angle of 45 degrees is required to disassemble the sign frame 100.

As can be seen from the above description, the sign frame 100 can be easily assembled and disassembled without requiring additional hardware (e.g., metal hinges) as the first coupling assembly 58 and the second coupling assembly 158 are formed (e.g., blow molded) into the first panel 10 and the second panel 12, respectively. Moreover, the durability of the sign frame 100 is enhanced over conventional sign frames that require hardware for assembly as the sign frame 100 will not suffer from corrosion. Additionally, in aspects where the panels 10, 12 are blow molded, the plurality of slots 34, 134 disposed in the panels 10, 12 provide additional strength to the panels 10, 12, eliminate sagging of the panels 10, 12 over time, reduce weight of the panels 10, 12, and provide loading advantages while the plurality of coring features 52, 152 provide added rigidity to the panels 10, 12.

In blow-molded implementations, "pinch-offs" in the blow mold to define a continuous, sealed and waterproof cavity (e.g., the chamber 26, the chamber 126) therein. Such a continuous cavity could also hold ballast (such as water or sand) if desired.

While some implementations have been illustrated and described, numerous modifications come to mind without significantly departing from the spirit of the disclosure, and the scope of protection is only limited by the scope of the accompanying claims. Terms such as "top," "bottom," "front," "rear," "upper," "lower," and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. In certain circumstances, multitasking and parallel processing may be advantageous. Moreover, the separation of various system components in the aspects described above should not be understood as requiring such separation in all aspects, and it should be understood that the described program components and systems can generally be integrated together in a single product or packaged into multiple products.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each article of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A sign frame, comprising:

a first panel;

a first coupling assembly integrally formed with the first panel;

a first channel and a first arm profile integrally formed with the first panel;

a second panel;

a second coupling assembly integrally formed with the second panel; and a second channel and a second arm profile integrally formed with the second panel, wherein the first channel forms a recess in the first panel and the second channel forms a recess in the second panel, wherein the second coupling assembly is removably coupled to the first coupling assembly, wherein the first panel operatively pivots with respect to the second panel, between a stowed position and a deployed position, about the first coupling assembly and the second coupling assembly that are removably coupled, wherein the first channel is designed to receive a portion of the second arm profile and the second channel is designed to receive a portion of the first arm profile, wherein the first and second channels operatively pivot with respect to the second and first arm profiles, between the stowed position and the deployed position.

2. The sign frame of claim 1, wherein the first coupling assembly comprises:

a first arm comprising a first projection, and a first receiver; and the second coupling assembly comprises:

a second arm comprising a second projection, and a second receiver, wherein the first projection is operatively received by the second receiver, and the second projection is operatively received by the first receiver.

3. The sign frame of claim 2, further comprising a first detent extending from the first arm, a second detent extending from the second arm, a first bump disposed proximate the first receiver, a first stop recessed into the first bump, a second bump disposed proximate the second receiver, and a second stop recessed into the second bump, wherein, in the deployed position, the first detent is operatively retained in the second stop and the second detent is operatively retained in the first stop.

4. The sign frame of claim 1, further comprising a first protrusion extending from the first panel, a first indent disposed adjacent the first protrusion, a second protrusion extending from the second panel, and a second indent disposed adjacent the second protrusion, wherein, in the deployed position, the first protrusion is operatively engaged with the second indent and the second protrusion is operatively engaged with the first indent to prevent the sign frame from being disassembled until a predetermined disassembly threshold degree of force is applied to the first panel and the second panel to exceed a threshold angle therebetween.

5. The sign frame of claim 4, wherein the threshold angle is 45 degrees.

6. The sign frame of claim 1, further comprising at least one handle cutout disposed through the first panel, wherein the at least one handle cutout is configured for lifting the sign frame when in the stowed position.

7. The sign frame of claim 1, wherein the first panel comprises a chamber disposed between a first surface of the first panel and a second surface of the first panel.

8. The sign frame of claim 7, further comprising a port extending from the second surface of the first panel, wherein the port is in fluid communication with the chamber.

9. The sign frame of claim 1, wherein the first panel comprises a plurality of coring features disposed therethrough configured to provide rigidity to the first panel.

10. The sign frame of claim 1, wherein the first panel comprises a plurality of slots disposed therethrough configured to provide structural strength to the first panel.

11. The sign frame of claim 1, wherein the first panel is integrally formed with the first coupling assembly via blow molding and the second panel is integrally formed with the second coupling assembly via blow molding.

12. A sign frame, comprising:

a first panel comprising a first front surface disposed opposite a first rear surface;

a first coupling assembly integrally formed with the first panel, the first coupling assembly comprising a first arm;

a first projection extending from the first arm;

a first receiver extending from the first rear surface of the first panel, the first receiver spaced apart from the first arm;

a first channel integrally formed with the first panel;

a first arm profile integrally formed with the first panel;

a second panel comprising a second front surface disposed opposite a second rear surface;

a second coupling assembly integrally formed with the second panel, the second coupling assembly comprising a second arm, the second coupling assembly removably coupled to the first coupling assembly;

a second projection extending from the second arm, the second projection operatively received by the first receiver;

a second receiver extending from the second rear surface of the second panel, the second receiver spaced apart from the second arm, the second receiver operatively receiving the first projection;

a second channel integrally formed with the second panel; and a second arm profile integrally formed with the second panel, wherein the first channel is recessed relative to the first rear surface of the first panel and the second channel is recessed relative to the second rear surface of the second panel, wherein the first panel operatively pivots with respect to the second panel, between a stowed position and a deployed position, about the first coupling assembly and the second coupling assembly that are removably coupled, wherein the first channel is designed to receive a portion of the second arm profile and the second channel is designed to receive a portion of the first arm profile, wherein the first and second channels operatively pivot with respect to the second and first arm profiles, between the stowed position and the deployed position.

13. The sign frame of claim 12, further comprising a first detent extending from the first arm, a second detent extending from the second arm, a first bump disposed proximate the first receiver, a first stop recessed into the first bump, a second bump disposed proximate the second receiver, and a second stop recessed into the second bump, wherein, in the deployed position, the first detent is operatively retained in the second stop and the second detent is operatively retained in the first stop.

14. The sign frame of claim 12, further comprising a first protrusion extending from the first panel, a first indent disposed adjacent the first protrusion, a second protrusion extending from the second panel, and a second indent disposed adjacent the second protrusion, wherein, in the deployed position, the first protrusion is operatively engaged with the second indent and the second protrusion is operatively engaged with the first indent to prevent the sign frame from being disassembled until a predetermined disassembly threshold degree of force is applied to the first panel and the second panel to exceed a threshold angle therebetween.

15. The sign frame of claim 14, wherein the threshold angle is 45 degrees.

16. The sign frame of claim 12, further comprising at least one handle cutout disposed through the first panel, wherein the at least one handle cutout is configured for lifting the sign frame when in the stowed position.

17. The sign frame of claim 12, wherein the first panel comprises a plurality of slots disposed therethrough configured to provide structural strength to the first panel.

18. The sign frame of claim 12, wherein the first panel is integrally formed with the first coupling assembly via blow molding and the second panel is integrally formed with the second coupling assembly via blow molding.

19. A panel for a sign frame, the panel comprising:

a first surface;

a second surface disposed opposite the first surface;

a first coupling assembly integrally formed with the second surface, the first coupling assembly comprising an arm;

a projection extending from the arm;

a receiver extending from the second surface, the receiver spaced apart from the arm;

a detent extending from the arm;

a bump disposed proximate the receiver; and a first stop recessed into the bump, wherein the coupling assembly is configured to removably couple with a second coupling assembly integrally formed with another panel.

20. The panel of claim 19, wherein the first coupling assembly is integrally formed with the second surface via blow molding.

* * * * *